United States Patent [19]

Engman

[11] Patent Number: 4,730,800

[45] Date of Patent: Mar. 15, 1988

[54] UNIVERSAL TAILPIPE HOLDING BRACKET

[76] Inventor: Milton C. Engman, 624 Glenview Dr., Des Moines, Iowa 50312

[21] Appl. No.: 881,328

[22] Filed: Jul. 2, 1986

[51] Int. Cl.[4] ..... E21F 17/02

[52] U.S. Cl. ..... 248/62; 248/316.5; 248/316.6; 248/70; 248/74.1

[58] Field of Search ..... 248/60, 62, 316.5, 230, 248/316.6, 231.6, 63, 58, 70, 74.1, 74.4, 231.5

[56] References Cited

U.S. PATENT DOCUMENTS

| | | | |
|---|---|---|---|
| 235,828 | 12/1880 | Thatcher | 248/316.6 |
| 892,105 | 6/1908 | White | 248/62 |
| 1,187,587 | 6/1916 | White | 248/60 |
| 1,398,401 | 11/1921 | Shaw | 248/231.6 |
| 2,744,706 | 5/1956 | Gerdy | 248/62 |
| 2,765,474 | 10/1956 | Duncan | 248/230 |
| 2,964,869 | 12/1960 | Berhoff et al. | 248/231.54 |
| 3,288,409 | 11/1966 | Bethea | 248/316.54 |
| 3,353,775 | 11/1967 | Sebo | 248/316.5 |
| 4,465,252 | 8/1984 | Donovan | 248/60 |

FOREIGN PATENT DOCUMENTS

| | | | |
|---|---|---|---|
| 240200 | 5/1965 | Austria | 248/231.5 |
| 2441297 | 3/1976 | Fed. Rep. of Germany | 248/62 |

OTHER PUBLICATIONS

Photograph (Submitted as Prior Art by the Applicant on 9/22/86).

*Primary Examiner*—Reinaldo P. Machado
*Assistant Examiner*—Alvin Chin-Shue
*Attorney, Agent, or Firm*—Zarley, McKee, Thomte, Voorhees & Sease

[57] ABSTRACT

A universal tailpipe holding bracket is provided and includes a support means for attachment to a vehicle frame or body, a clamp assembly for holding the tailpipe, and a universal connector for connecting the clamp assembly to the support strap. The clamp assembly includes substantially semi-circular first and second clamp sections, each of which have opposite first and second ends. The first end of the first clamp section has an outwardly projecting detent while the first end of the second clamp section has a plurality of longitudinally spaced apart openings therein. The second end of each clamp section terminates in an outwardly projecting flange. A bolt or screw connects the flanges of the clamp sections. The detent is adapted to be selectively received within one of the openings on the first end of the second clamp section, depending on the diameter of the tailpipe. When the connecting bolt or screw is loosened, the detent can be released from the opening in the first end of the second clamp section to define an enlarged mouth area through which the tailpipe can be passed. When the tailpipe is in position between the two clamp sections, the bolt or screw can be tightened so as to draw the first and second clamp sections into tight engagement with the tailpipe.

4 Claims, 7 Drawing Figures

UNIVERSAL TAILPIPE HOLDING BRACKET

BACKGROUND OF THE INVENTION

Brackets for securing tailpipes to a vehicle frame or body are commonly known. These brackets generally take the form of a strap having an upper end secured to the frame or body of the vehicle with a U-bolt connected to the lower end of the strap. A base portion having an arcuate surface is secured to the legs of the U-bolt by a pair of nuts so as to form a circular opening through which the tailpipe extends.

One disadvantage with this conventional tailpipe bracket is the need to remove both nuts from the legs of the U-bolt so that the base portion can be separated therefrom when the tailpipe must be replaced. Also, the conventional tailpipe bracket must be manufactured in varying sizes since the U-bolt and base portion do not conform to different sized tailpipes.

Therefore, a primary objective of the present invention is the provision of a universal tailpipe holding bracket which permits quick and easy replacement of the tailpipe.

Another objective of the present invention is the provision of a tailpipe bracket which can accommodate various sizes of tailpipes.

Still a further objective of the present invention is the provision of a tailpipe bracket which requires the loosening of only one bolt for the replacement of a tailpipe.

Another objective of the present invention is the provision of a tailpipe bracket which is economical to manufacture and durable in use.

These and other objectives will become apparent from the following description.

SUMMARY OF THE INVENTION

The universal tailpipe holding bracket of the present invention includes a rubber or metal support strap which has an upper end secured to the vehicle frame or body. A substantially semi-circular first clamp section is attached to the lower end of the support strap by a universal connector which permits the first clamp section to be pivoted about both a horizontal or vertical axis. The first clamp section has a first end terminating in an outwardly projecting detent, and an opposite second end terminating in an outwardly projecting flange. A substantially semi-circular second clamp section has a longitudinal axis and a plurality of slotted openings spaced longitudinally adjacent the first end and an opposite second end terminating in an outwardly projecting flange. The detent is adapted to be received in one of the slotted openings and the flanges are secured together such that the first and second clamp sections form a substantially circular opening through which the tailpipe extends. A bolt or screw extends through a hole in the flange of the first clamp section and an elongated opening in the flange of the second clamp section and can be tightened to draw the flanges together when the tailpipe extends through the circular opening and the detent is selectively received in one of the slotted openings of the second clamp, and thereby draw the first and second clamp sections into tight engagement with the tailpipe. An inwardly extending dimple on the second clamp section provides increased frictional engagement between the tailpipe and the bracket when the clamp sections are drawn together.

DETAILED DESCRIPTION OF THE DRAWINGS

Figure 1:
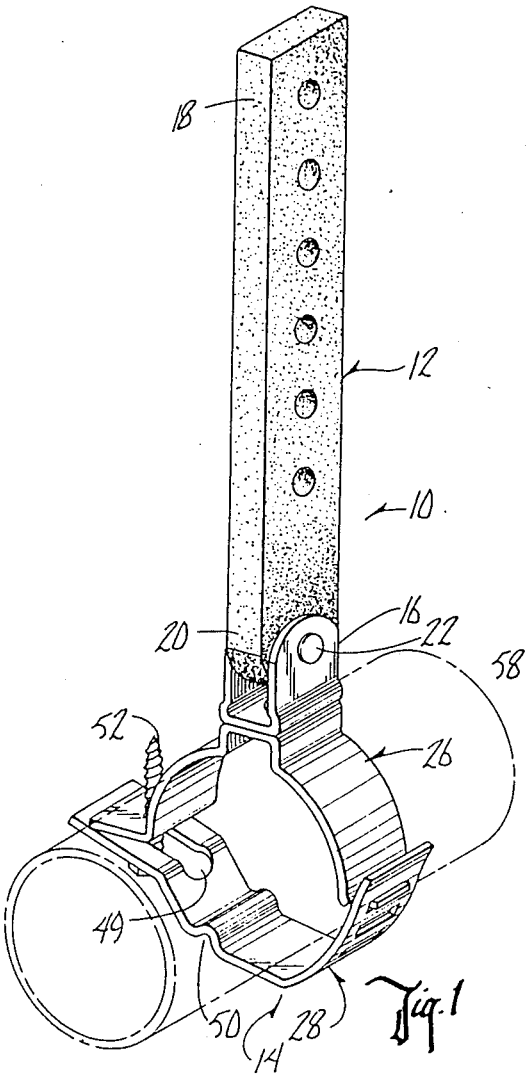
FIG. 1 is a perspective view of the universal tailpipe holding bracket of the present invention.
Figure 2:
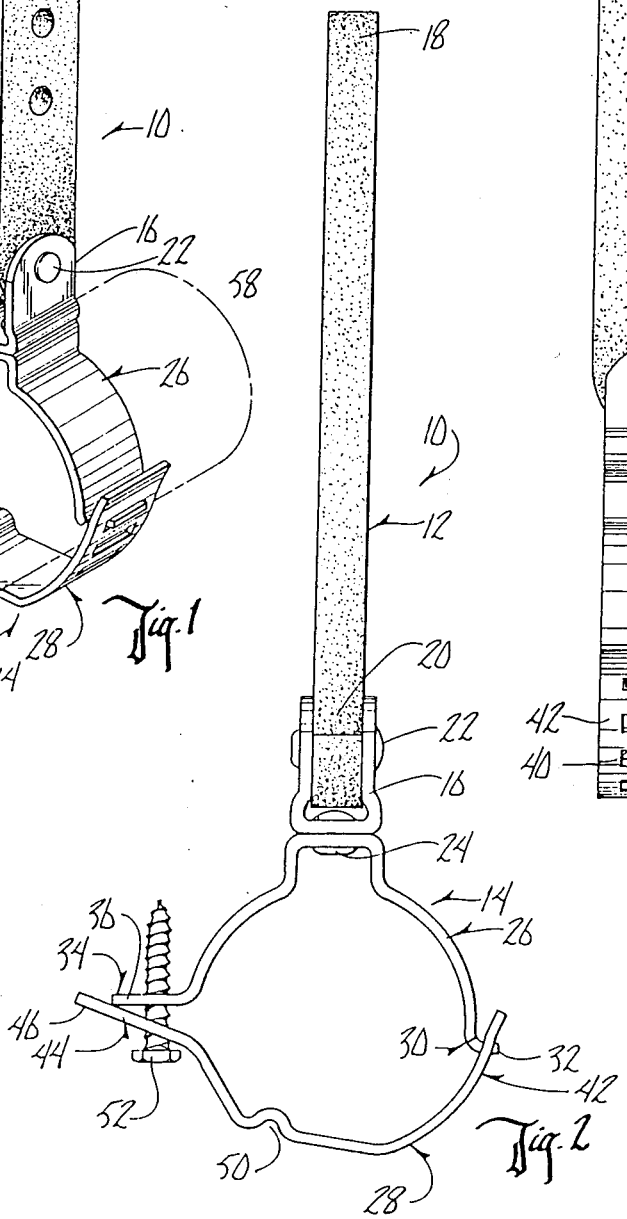
FIG. 2 is an end elevational view of the bracket.
Figure 3:
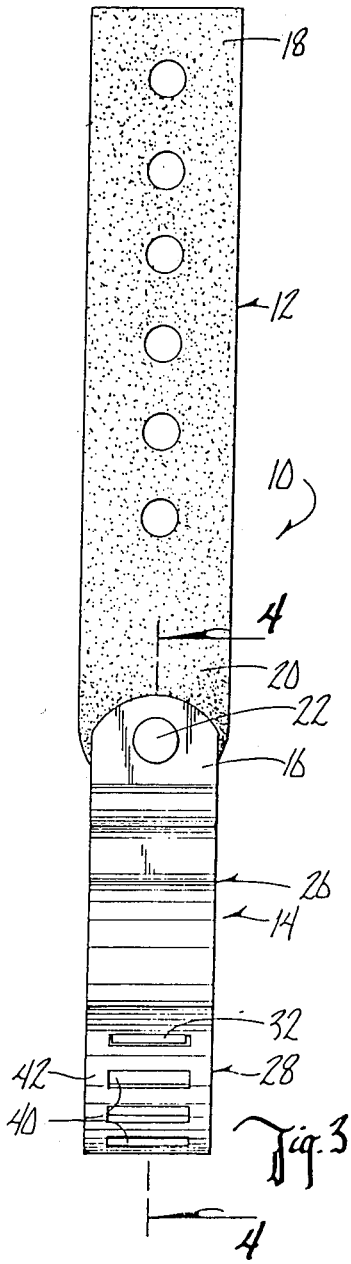
FIG. 3 is a side elevational view of the bracket.

The universal tailpipe holding bracket of the present invention is generally designated by the reference numeral 10 in the drawings. The bracket includes a support strap 12, a clamp assembly 14, and a universal connector 16 interconnecting the bracket and the support strap. The upper end 18 of support strap 12 is connected to the vehicle frame or body and the lower end 20 is connected to the universal connector 16 by a generally horizontally disposed pin 22. The clamp assembly 14 is connected to the universal connector 16 by a generally vertically disposed pin 24. Pins 22 and 24 allow clamp assembly 14 to be pivoted about both a horizontal and a vertical axis.

Clamp assembly 14 includes an upper first clamp section 26 and a lower second clamp section 28. Each section 26 and 28 is substantially semi-circular. First clamp section 26 has a first end 30 terminating in an outwardly projecting detent 32 and a second end 34 terminating in an outwardly projecting flange 36. Flange 36 has an opening 38 extending therethrough. Second clamp section 28 has a longitudinal axis and a plurality of longitudinally spaced apart openings 40 adjacent the first end 42 thereof and an opposite second end 44 terminating in an outwardly projecting flange 46. Flange 46 has an elongated opening 48 extending therethrough. Opening or slot 48 has an enlarged portion 49 at one end for a later described purpose. Second clamp section 28 also has an inwardly projecting dimple 50 intermediate the opposite ends thereof.

Figure 4:
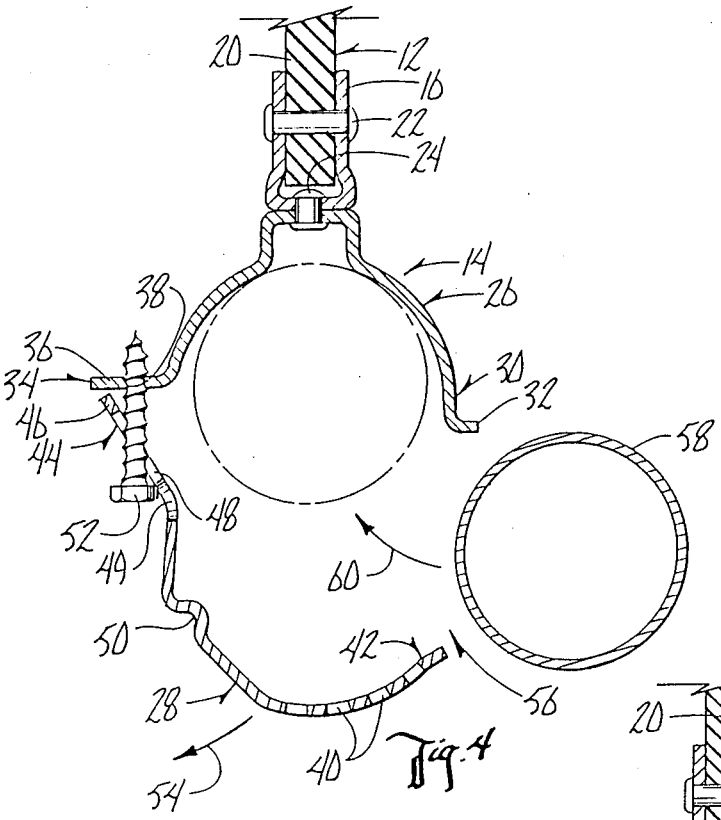
FIG. 4 is a sectional view taken along lines 4—4 of FIG. 3 showing the bracket in an open position for receiving a tailpipe.

A closure means 52 such as a bolt or screw extends through the openings of flanges 36 and 46 so as to secure the flanges together. The closure means is adjustable between a tightened position shown in FIG. 6 wherein the flanges are securely connected to one another, and a loosened position shown in FIGS. 4 and 5 wherein the flanges are loosely connected to one another. The enlarged portion 49 of slot 48 permits a socket wrench to be used on the head of the bolt or screw closure means without interference by the curvature of second clamp section 28. When closure means 52 is in the loosened positin, second clamp section 28 is pivotal about a substantially horizontal axis, as indicated by arrow 54 in FIG. 4, such that the first end 42 of second clamp section 28 can be spaced apart from first end 30 of first clamp section 26 and thereby define an enlarged mouth area 56 through which a tailpipe 58 can be passed as indicated bY arrow 60 in FIG. 4.

Figure 5:
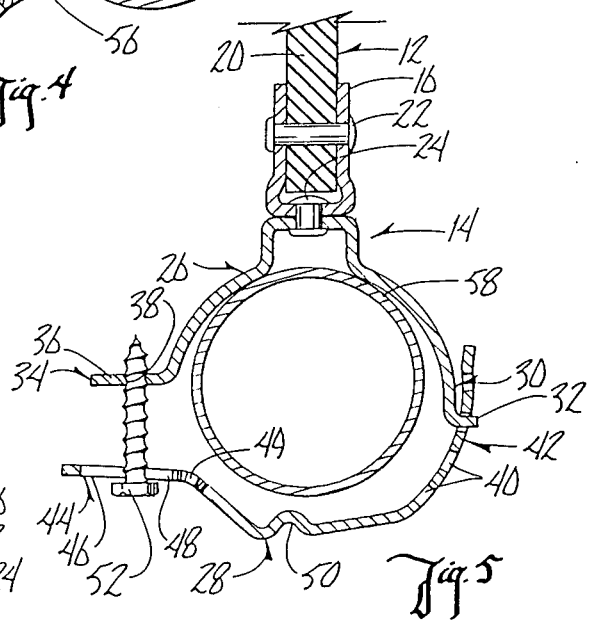
FIG. 5 is a view similar to FIG. 4 showing the tailpipe in a closed but untightened arrangement with the tailpipe extending therethrough.
Figure 6:
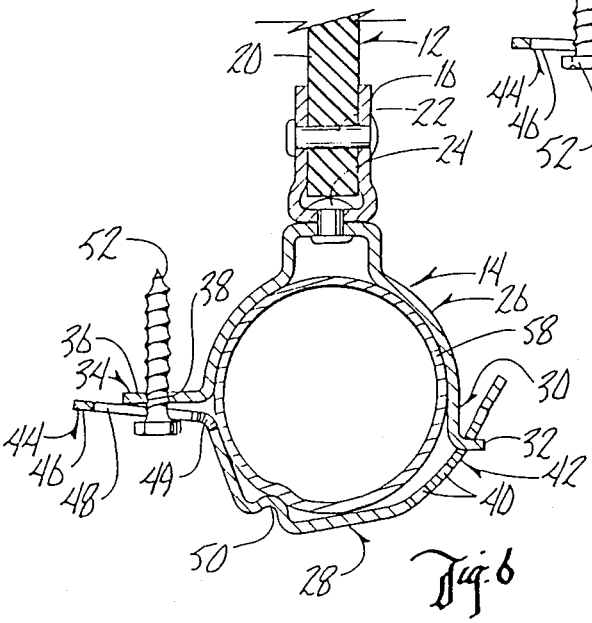
FIG. 6 is a view similar to FIG. 5 showing the bracket in a closed and tightened position about the tailpipe.

After tailpipe 58 has been inserted through mouth area 56 and into the substantially circular opening between clamp sections 26 and 28, first end 42 of second clamp section 28 can be moved towards first end 30 of first clamp section 26 and detent 32 can be selectively inserted into one of openings 40, depending on the diameter of tailpipe 58, as shown in FIG. 5. Closure means 52 can then be tightened such that clamp sections 26 and 28 tightly engage tailpipe 58, as shown in FIG. 6. When closure means 52 is tightened, dimple 50 tends to deform tailpipe 58 slightly so as to prevent it from turning and to provide increased frictional engagement between the clamp assembly and the tailpipe.

It is understood that the above described procedure is reversed in the event that the tailpipe must be removed from the bracket. Also, it is important to note that closure means 52 does not need to be completely removed from the bracket such that first and second clamp sections 26 and 28 are disconnected from one another. Rather, closure means 52 need only be loosened sufficiently to permit disengagement of detent 32 from the selected opening 40. The elongated opening 48 in flange 46 allows second clamp section 28 to pivot such that the detent can be freed from the respective opening 40 without removing closure means 52 completely from the clamp sections.

Figure 7:
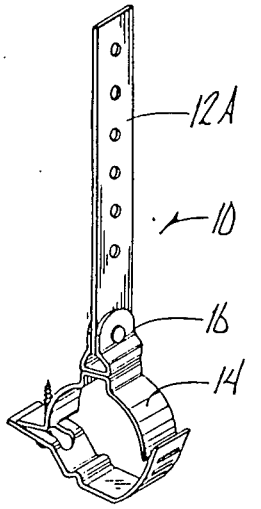
FIG. 7 is a perspective view showing a second embodiment of the tailpipe bracket of the present invention.

Preferably, clamp assembly 14 and universal connector 16 are made of hardened steel or other sufficiently strong metal. Support strap 12 is preferably made of rubber or the like, as shown in FIGS. 1–6, but may also be made of metal, as indicated at 12A in FIG. 7.

From the foregoing, it is seen that the present invention accomplishes at least all of the stated objectives.

What is claimed is:

1. A bracket for holding a tailpipe, comprising:

a support means for attachment to a vehicle frame, a first clamp section being substantially semi-circular in shape, and having opposite first and second ends, and being pivotally secured to said support means, a detent means on said first end of said first clamp section, and a flange means on said second end thereof, a second clamp section being substantially semi-circular in shape and having opposite first and second ends, and being complementary in shape to said first clamp section so that said first and second clamp sections form a substantially circular opening when said first and second ends of said first clamp sections engage said first and second ends, respectively, of said second clamp section;

a plurality of slot openings in said second clamp section in spaced relation along the longitudinal axis thereof adjacent said first end thereof, each of said openings being adapted to receive therein said detent means on said first clamp section, such that the diameter of said circular opening can be adjusted to hold different diameter tailpipes, a flange on said second end of said second clamp section adapted to be superimposed on said flange on said first clamp section, closure means on said flanges of said first and second clamp sections for drawing them towards each other when said tailpipe extends through said circular opening and said detent on said first clamp section is received in one of the openings in said second clamp sections to draw said first and second clamp sections into tight engagement with said tailpipe, said closure means being adjustable between a tightened position wherein said flanges are securely connected to one another and a loosened position wherein said flanges are loosely connected to one another and free to move relative to one another such that said detent can be selectively received within one of said slot openings, and said closure means extending through an opening in said flange on said second end of said first clamp section and through an elongated opening in said flange on said second end of said second clamp section, said elongated opening permitting pivotal movement of said second clamp section about a horizontal axis when said closure means is in said loosened position whereby said first end of said second clamp section is movable away from said first end of said first clamp section so as to define an enlarged mouth through which said tailpipe is passed for receipt into said circular opening without complete removal of said closure means from said flanges, "said elongated opening further comprising an enlarged opening in the semi-circular portion of said second clamp section to provide clearance for a socket wrench used for tightening and loosening said closure means" has been inserted after "flanges".

2. The bracket of claim 1 wherein said support means includes a universal joint to permit said first clamp section to be pivoted about horizontal and vertical axes.

3. The bracket of claim 2 wherein said second clamp section has a raised portion therein to tightly frictionally engage said cylindrical pipe when said closure means draws said clamp sections together.

4. The bracket of claim 1 wherein said closure means is a bolt assembly, and said second clamp section has an opening adjacent said bolt assembly to provide clearance for a socket wrench mounted on said bolt assembly.

* * * * *